United States Patent [19]

Itho

[11] Patent Number: 4,616,594

[45] Date of Patent: Oct. 14, 1986

[54] PAINTING BOOTH

[75] Inventor: Joji Itho, Toyota, Japan

[73] Assignee: Toyota Jidosha Kabushiki Kaisha, Toyota, Japan

[21] Appl. No.: 669,057

[22] Filed: Nov. 7, 1984

Related U.S. Application Data

[63] Continuation of Ser. No. 505,467, Jun. 17, 1983, abandoned.

[51] Int. Cl.[4] ..... B05B 13/02; B05B 15/12

[52] U.S. Cl. ..... 118/326; 98/115.2; 55/DIG. 46; 118/DIG. 7

[58] Field of Search ..... 427/421, 424; 118/326; 98/115.5 B; 55/DIG. 46

[56] References Cited

U.S. PATENT DOCUMENTS 4,048,912 9/1977 Walker ..... 98/115.5 B 4,132,357 1/1979 Blackinton ..... 427/421

4,269,112 5/1981 Cordier ..... 55/DIG. 46

4,537,120 8/1985 Josefsson ..... 55/DIG. 46 X

FOREIGN PATENT DOCUMENTS 960989 6/1974 United Kingdom ..... 118/326

*Primary Examiner*—Shrive P. Beck

*Attorney, Agent, or Firm*—Oblon, Fisher, Spivak, McClelland & Maier

[57] ABSTRACT

A painting booth in which an appropriate temperature and humidity control is effectively performed for that zone in the painting chamber in which the object to be painted is conveyed, for enabling a drastic reduction in the amount of energy required for such temperature and humidity control, as compared with a conventional painting booth within which such control is performed for the whole painting chamber.

10 Claims, 1 Drawing Figure

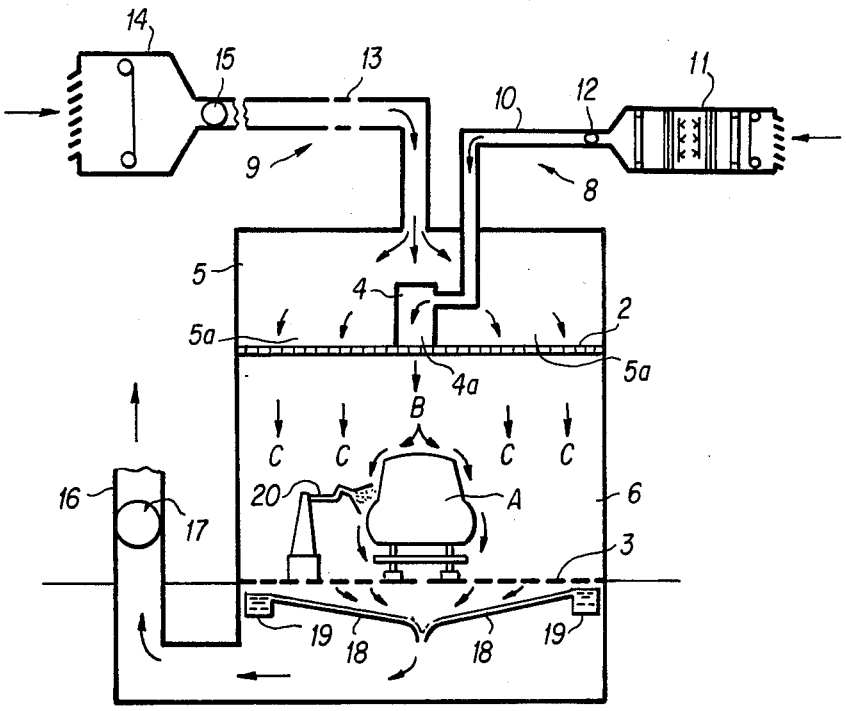
14
15
13
11
10
12
9
8
5
4
2
5a
5a
4a
B
C
C
C
C
16
20
A
6
17
3
19
18
18
19

PAINTING BOOTH

This application is a continuation of application Ser. No. 505,467, filed June 17, 1983, abandoned.

BACKGROUND OF THE INVENTION

1. Field of the Invention

This invention relates to a painting booth in which the object to be painted, such as an automobile body, is painted.

2. Description of the Prior Art

In a conventional painting booth, air (air-supply gas) having a uniformly controlled temperature and humidity under the same condition is supplied to the entire painting chamber to maintain the painting quality of the object to be painted. A large quantitiy of air is, however, exhausted without contacting the object directly, resulting in a large quantity of energy wasted in controlling the temperature and humidity of such air.

SUMMARY OF THE INVENTION

It is an object of this invention to solve the problem as hereinabove pointed out, and provide a painting booth in which air having an appropriately controlled temperature and humidity is supplied along the object to be painted in order to maintain the temperature and humidity of the atmosphere around the object at predetermined levels with only a small quantity of air, thereby eliminating any waste of energy. The painting booth of this invention is characterized by a system in which air having an appropriately controlled temperature and humidity is supplied into a zone in the painting chamber through which the object to be painted is conveyed.

Still another object of the present invention is to provide a painting booth comprising a filter, a drainboard, a first air supply chamber, a second air supply chamber, a painting chamber, a paint mist separating chamber, a first air supply system and a second air supply system.

Still another object of the present invention is to provide a painting booth provided with the first air supply system which includes the first air supply chamber, an air duct, an air conditioner, a fan for delivering air and an air-supplying opening so as to supply air having an appropriately controlled temperature and humidity into a zone in the painting chamber through which the object to be painted is conveyed.

Still another object of the present invention is to provide a painting booth provided with the second air supply system which includes a second air supply system comprising a second air supply chamber, an air duct, a duct collector, a fan for delivering air and an air-supplying opening so as to supply air in the other zones apart from the object to be painted.

Still another object of the present invention is to provide a painting booth having the paint mist separating chamber which includes an exhaust dust, a fan for drawing and discharging air separated from paint into the exterior, water feeding plates, and troughs.

The above and other objects, features and advantages of the present invention will become more apparent from the following description when taken in conjunction with the accompanying drawing in which a preferred embodiment of the present invention is shown by way of illustrative example.

BRIEF DESCRIPTION OF THE DRAWING

The sole FIGURE is a schematic view showing an embodiment of this invention.

DESCRIPTION OF THE PREFERRED EMBODIMENT

The invention will now be described by way of example with reference to the drawing.

Referring to the sole FIGURE, a painting booth is shown at reference number 1, and divided by a filter 2 and a drainboard 3 into a first air supply chamber 4, a second air supply chamber 5, a painting chamber 6 and a paint mist separating chamber 7.

A first air supply system 8 is provided above the painting booth 1 for supplying air having an appropriately controlled temperature and humidity into a zone in the painting chamber 6 through which the object to be painted is conveyed. A second air supply system 9 is likewise provided for supplying air, within which the temperature and humidity have not been controlled, into the painting chamber 6, excluding the zone through which the object is conveyed.

The first air supply chamber 4 forms a part of the first air supply system 8, and extends in the direction in which the object A to be painted is conveyed. The first air supply system 8 further comprises an air duct 10 connected to the first air supply chamber 4, an air conditioner 11 for controlling the temperature and humidity of the air introduced from the exterior, and a fan 12 for delivering air having an appropriately controlled temperature and humidity through the duct 10. The first air supply chamber 4 has an air-supplying opening **4*a* for facing the painting chamber 6, and has a width which is smaller than that of the object A to be painted. The air introduced into the air supply chamber 4 is diffused and rectified therein to form a substantially uniform stream which is delivered through the filter 2 into a prescribed zone in the painting chamber 6. A damper (not shown) may be provided in the air duct 10** for regulating the amount of air to be supplied.

The second air supply system 9 is substantially similar in construction to the first air supply system 8, and comprises the second air supply chamber 5, an air duct 13 connected to the second air supply chamber 5, a dust collector 14 for removing dust from the air introduced from the exterior, and an air-supply fan 15. The second air supply chamber 5 extends in the direction in which the object A is conveyed, and has an air-supplying opening **5*a* facing the painting chamber 6 and a width which is substantially equal to that of the painting chamber 6. A damper may be provided in the duct 13** for regulating the amount of air to be supplied.

An exhaust duct 16 is connected to the paint mist separating chamber 7, and provided with a fan 17 by which the air separated from the paint mist is drawn and discharge to the exterior. A pair of water feeding plates 18 are provided in the paint mist separating chamber 7 and inclined downwardly toward the center thereof. A trough 19 is provided for each water feeding plate 18 to supply washing water thereto. A painting device 20 is provided in the painting chamber 6.

In operation, the fans 12 and 15 in the air supply systems and the fan 17 in the exhaust system are placed in operation to introduce air into the first and second air supply systems 8 and 9. The air flows through the duct 10 and 13 in the directions of the arrows in the sole FIGURE, and enters the first and second air supply chambers 4 and 5. The air is rectified in each chamber, and dust is removed therefrom by the filter 2 before it enters the painting chamber 6.

The air in the first air supply system 8 has a temperature and humidity which are appropriately controlled by the air conditioner 11, and delivered from a point immediately above the object A into the painting chamber 6. The air flows in the direction shown by bold arrowlines B, strikes the object A and is divided to flow down along opposite sides of the object A. The object A is, therefore, surrounded by an atmosphere having an appropriately controlled temperature and humidity. The air supplied through the second air supply system 9 flows in the other zones apart from the object A in the direction shown by arrowlines C, is disclosed from the painting chamber 6 and flows into the paint mist separating chamber 7.

The air leaving the painting chamber 6 contains the paint mist and solvent scattered without adhering to the object A being painted. Washing water flows from the troughs 19 down the water feeding plates 18, and contacts the air at the edges of the plates 18 to separate the paint mist from the air. The air is then discharged through the exhaust duct 16 to the exterior.

The air introduced into the air conditioner 11 is so conditioned as to have a temperature of 18° C. to 28° C. and a humidity of 80%±5%, depending on the season. On the contrary, the exterior air is directly used in the second air supply system, though dust in said air is removed by the dust collector 14. If the painting booth has, for example, a width of 6 m and a length of 50 m, the first air supply system 8 supplies air at a rate of about 500 $m^3$/min., and the second air supply system 9 supplies air at a rate of about 5,000 $m^3$/min.

In the painting booth 1, the control of temperature and humidity is effected only for the air around the object A; therefore, it is possible to achieve a drastic reduction in the amount of energy required to effect such temperature and humidity control for the air in the whole painting chamber in a conventional painting booth. It is, however, also possible to provide temperature and humidity control in the second air supply system of the painting booth according to this invention under different conditions as compared with the control for the first air supply system.

This invention provides a painting booth in which an appropriate temperature and humidity control is effectively performed for that zone in the painting chamber in which the object to be painted is conveyed, as hereinabove described. It therefore enables a drastic reduction in the amount of energy required for such temperature and humidity control, as compared with a conventional painting booth in which such control is performed for the whole painting chamber.

Obviously, numerous modifications and variations of the present invention are possible in light of the above teachings. It is therefore to be understood that within the scope of the appended claims, the invention may be practiced otherwise than as specifically described herein.

What is claimed is:

1. A painting booth for painting an object, comprising:

a painting booth having a filter and a drainboard positioned therein and forming a first air supply chamber above said object to be painted and extending in a direction in which said object to be painted is conveyed, said first air supply chamber having an air-supplying opening facing said filter and having a width which is smaller than that of the object to be painted; a second air supply chamber in which said first air supply chamber is disposed and which is defined by said filter and extending in a direction in which said object to be painted is conveyed; a painting chamber defined by said filter and said drainboard; and a paint mist separating chamber defined by said drainboard in said painting booth;

a painting device positioned in said painting chamber;

a first air supply system comprising said first air supply chamber operatively connected with said painting booth and including means for supplying air which flows through said opening of said first air supply chamber to strike said object and to flow down along opposite sides of said object, said object being centrally located in the painting booth, and means for controlling the temperature and humidity of the air to be supplied into a zone in said painting chamber through which said object to be painted is conveyed; and a second air supply system operatively connected with said painting booth and including means for supplying air without a controlled temperature and humidity into said painting chamber exclusive of said zone through which said object is conveyed.

2. A painting booth as claimed in claim 1, wherein said first air supply system further comprises an air duct connected to the first air supply chamber, an air conditioner connected to air duct for controlling the temperature and humidity of the air introduced from the exterior, and a fan for delivering air having an appropriately controlled temperature and humidity through the air duct.

3. A painting booth as claimed in claim 2, further comprising means for conditioning air passing through said air conditioner as to have a temperature of 18° C. to 28° C. and a humidity of 80%±5%.

4. A painting booth as claimed in claim 2, further comprising a damper positioned in said air duct for regulating the amount of air to be supplied.

5. A painting booth as claimed in claim 1, wherein the second air supply system further comprises said second air supply chamber, an air duct connected to the second air supply chamber, a dust collector connected to said air duct for removing dust from air introduced from the exterior, and an air supply fan operatively connected to said air duct.

6. A painting booth as claimed in claim 5, further comprising a damper positioned in said air duct for regulating the amount of air to be supplied.

7. A painting booth as claimed in claim 5, wherein said dust collector further comprises means for removing dust in the air in the exterior used in the second air supply system.

8. A painting booth as claimed in claim 1, 2 or 5 wherein said fan of said first air supply system further comprises means for supplying air at a rate of at least 500 $m^3$/min., and said fan of said second air supply system further comprises means for supplying air at a rate of at least 5,000 $m^3$/min.

9. A painting booth as claimed in claim 1 or 5 wherein the second air supply chamber has an air-supplying opening therein facing said painting chamber and having a width substantially equal to that of said painting chamber.

10. A painting booth as claimed in claim 1, wherein said paint mist separating chamber further comprises at least one pair of water feeding plates inclined downwardly toward the center of the paint mist separating chamber, trough means operatively connected with each water feeding plate for supplying washing water to the water feeding plate, an exhaust duct connected to the paint mist separating chamber for separating air from paint mist and drawing and discharging the separated air to the exterior.

* * * * *

UNITED STATES PATENT AND TRADEMARK OFFICE

CERTIFICATE OF CORRECTION

PATENT NO. : 4,616,594

DATED : October 14, 1986

INVENTOR(S) : Joji Itho

It is certified that error appears in the above-identified patent and that said Letters Patent is hereby corrected as shown below:

On the title page, Item [30] should be inserted to read as follows:

-- Foreign Application Priority Data

June 17, 1982 [JP] Japan.....Sho 57-90718 --.

Signed and Sealed this

First Day of December, 1987

*Attest:*

DONALD J. QUIGG

*Attesting Officer*

*Commissioner of Patents and Trademarks*